US006226900B1

(12) United States Patent
Mazars

(10) Patent No.: US 6,226,900 B1
(45) Date of Patent: May 8, 2001

(54) SHOE COMPRISING A GRIND INSERT

(75) Inventor: Sébastien Mazars, Boulder, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/402,862

(22) PCT Filed: Feb. 5, 1999

(86) PCT No.: PCT/FR99/00254

§ 371 Date: Oct. 13, 1999

§ 102(e) Date: Oct. 13, 1999

(87) PCT Pub. No.: WO99/40810

PCT Pub. Date: Aug. 19, 1999

(30) Foreign Application Priority Data

Feb. 16, 1998 (FR) ..... 98 01992

(51) Int. Cl.[7] ..... A43B 5/00

(52) U.S. Cl. ..... 36/132; 36/115; 36/114; 36/107; 36/73

(58) Field of Search ..... 36/132, 115, 114, 36/107, 73, 72 A, 72 R

(56) References Cited

U.S. PATENT DOCUMENTS

| | | | | |
|---|---|---|---|---|
| D. 426,054 | | 6/2000 | Mazars | D2/959 |
| 5,716,723 | | 2/1998 | Van Cleef et al. | 428/690 |
| 5,970,631 | * | 10/1999 | Inman | 36/115 |
| 6,006,451 | * | 12/1998 | Morris et al. | 36/115 |
| 6,061,930 | | 5/2000 | Zinovieff | 36/115 |

* cited by examiner

*Primary Examiner*—Ted Kavanaugh
*Assistant Examiner*—Troy Arnold
(74) *Attorney, Agent, or Firm*—Greenblum & Bernstein, P.L.C.

(57) ABSTRACT

A grind shoe including a sole provided on its lower surface with a transverse gliding and wear reinforcement arranged in the sole central zone. The transverse reinforcement has the shape of a portion of a cylinder arranged transversely to the sole longitudinal axis, with a concave curvature oriented downwardly. The shoe also includes a longitudinal reinforcement arranged on either side of the transverse reinforcement and defining a longitudinal groove on either side of the transverse reinforcement.

54 Claims, 6 Drawing Sheets

SHOE COMPRISING A GRIND INSERT

BACKGROUND OF THE INVENTION

1. Field of the Invention

The present invention concerns a "grind" shoe; i.e., a shoe adapted for executing figures by gliding on various linear supports, such as staircase guard rails, tracks, wall or fence ridges, etc.

Such figures are currently performed in the arena of the so-called "aggressive" practice of in-line skating.

2. Description of Background and Relevant Information

In DE 296 13 508 it was proposed to equip the lower surface of a shoe sole with a reinforcement that can be compared to the reinforcements used on in-line skates and called grind blocks. Such a reinforcement, in fact, consists of a gliding and wear part affixed in a detachable manner to the sole to allow the aforementioned glides.

There is also a shoe on the market, represented in FIG. 1, in which the sole 1 comprises, at the level of the arch of the foot a gliding and wear plate 2 fixed to the sole by means of a screw 3 cooperating with an insert (not represented in the Figure) arranged between the sole and the upper.

As shown in FIG. 1, the gliding and wear plate of this known shoe has a very "flat" rectangular shape. Such a gliding plate shape does not permit in practice the performance of more than one type of figure, namely, the one called "Royal", which consists of gliding on a bar or similar surface with both feet parallel and arranged transverse to the gliding direction on said bar.

As a matter of fact, the flat shape of the glide and wear plate does not permit a "locking" effect; i.e., jamming or wedging, on the glide support.

Such a construction therefore allows gliding only, and does not furnish any means for guiding or braking In addition, the insert on which the gliding and wear plate is fixed is arranged directly between the upper of the shoe and the sole and can therefore be a source of discomfort, especially in walking.

Finally, in this known construction, the gliding and wear plate may be easily torn off owing to its being fixed only by the screws 3, which are also subject to wear.

SUMMARY OF THE INVENTION

The object of the present invention is to overcome these drawbacks and to provide an improved so-called "grind" shoe, which allows especially performing a greater number of figures. This object is obtained in the shoe according to the invention, which is of the type comprising a sole provided on its lower surface with a transverse wear reinforcement arranged in said sole central zone, in that the transverse reinforcement has the shape of a cylinder portion, arranged transversely to the longitudinal axis of the sole, and with a concave curvature oriented downwards.

Indeed, the arched configuration of the gliding and wear reinforcement in the sole central zone allows for abetter fit of the shoe on the gliding surface and allows especially "edge setting" similar to those found in alpine skiing, allowing for slowing down and thus controlling the glide.

The shoe preferably comprises a longitudinal reinforcement, arranged on either side of the Verse reinforcement, and defining a longitudinal groove on either side of said transverse reinforcement. The "cross"-shaped reinforcement thus obtained allows performing other figures, creating the possibility of doing glides along the longitudinal axis of the foot.

BRIEF DESCRIPTION OF THE DRAWING

The invention will be better understood and other characteristics of the same will become evident with the help of the following description, with reference to the attached schematic drawings illustrating as non-limiting examples some examples of embodiments in which.

DETAILED DESCRIPTION OF THE INVENTION

Figure 2:
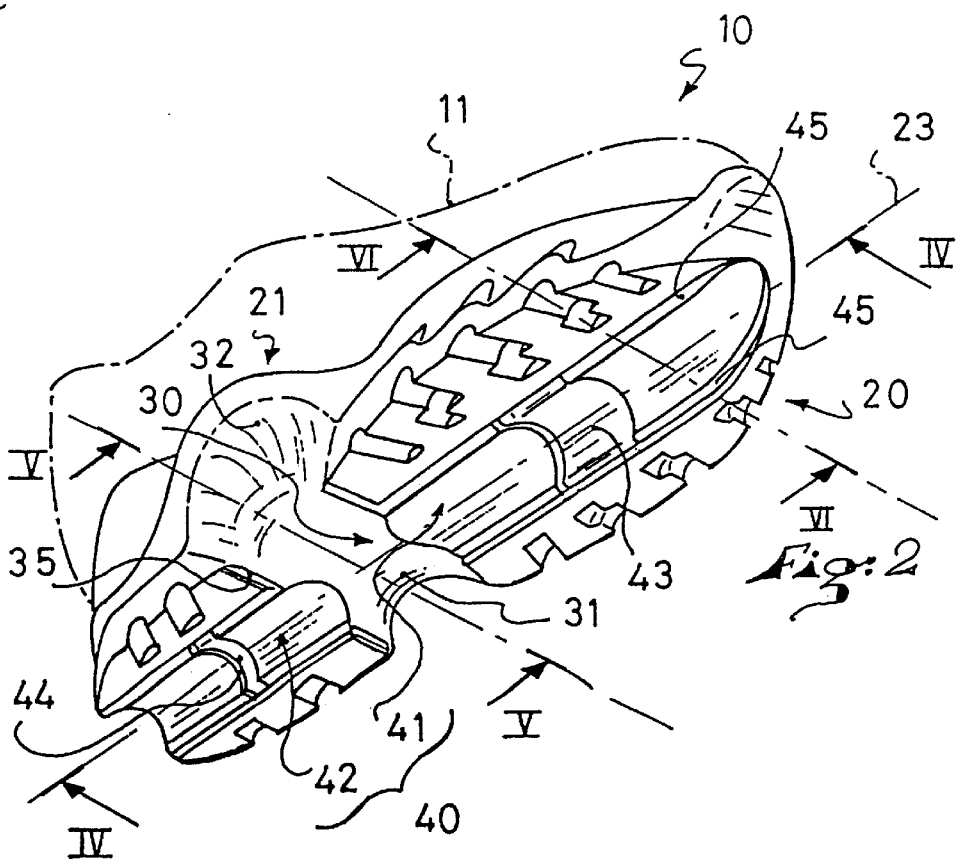
FIG. 2 is a figure similar to FIG. 1 of a shoe according to a first embodiment of the invention.

As shown in FIG. 2, the "grind" shoe 10 according to the invention consists of a sole 20 overlaid with an upper 11 (represented by a dot-dash line in the figure).

The sole 20 comprises, on its lower surface, two gliding and wear reinforcements, transverse 30 and longitudinal 40, respectively. "Longitudinal" refers to a lengthwise dimension between the front and rear ends of the sole, and "transverse" refers to a widthwise dimension across the longitudinal dimension, between the medial and lateral sides of the sole.

The transverse reinforcement 30 is arranged transversely in the sole central zone 21. It has the shape of a portion of a cylinder of revolution having one concavity oriented downwardly, in a longitudinal cross section, as seen in FIG. 4.

Figure 4:
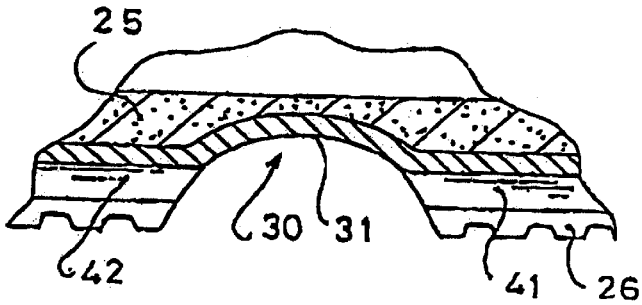
FIG. 4 is a cross-sectional view along IV—IV in FIG. 2.

This cylinder portion has a substantially constant radius of curvature comprised, in this case, between 30 and 40 mm (see FIG. 4). Such radius of curvature is a compromise with respect to the majority of glide surfaces used and thus allows better guidance and gripping, and thus improved braking possibilities, on such surfaces. As a result, a greater number of figures may already be performed due to this simple construction with respect to the prior art. Of course, other values of radius of curvature may equally be chosen.

Figure 3:
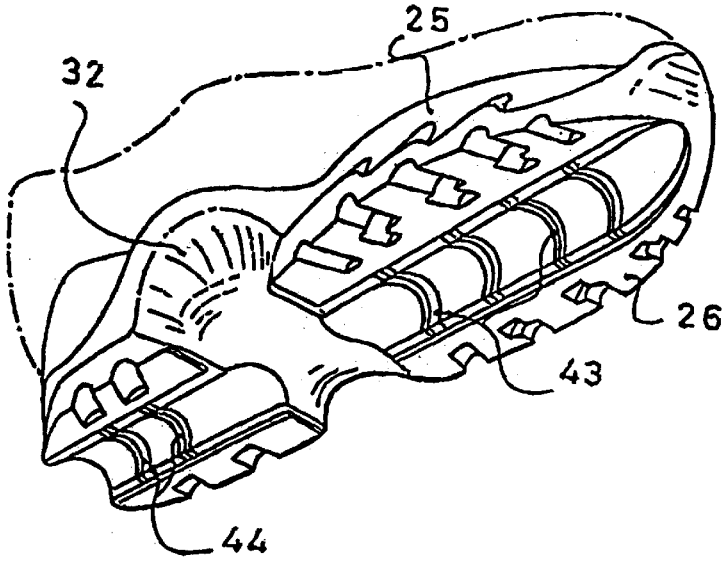
FIG. 3 is a figure similar to FIG. 2 according to a second embodiment.
Figure 5:
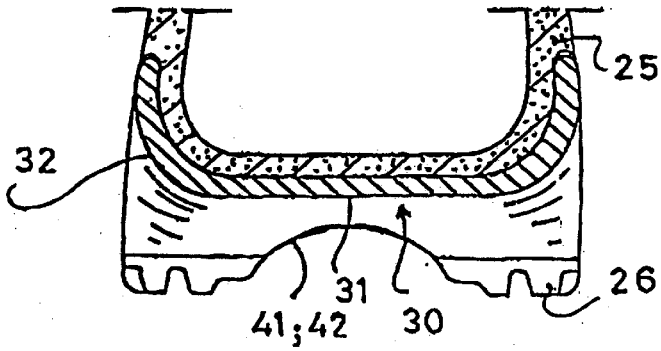
FIG. 5 is a cross-sectional view along V—V in FIG. 2.

As shown more specifically in FIGS. 2 and 5, the transverse reinforcement 30 is extended on both sides of the sole by a side rise 32 which has, in a transverse direction of the shoe, a convex curvature which, in the longitudinal direction, widens from the bottom 31 of the cylinder portion towards the outside of the sole. As can be seen in FIGS. 2 and 3, e.g., and more particularly in FIG. 5, the transition between the side rises 32 and the remainder of the transverse reinforcement 30 is continued, i.e., there is no edge demarcating surface portions.

Figure 1:
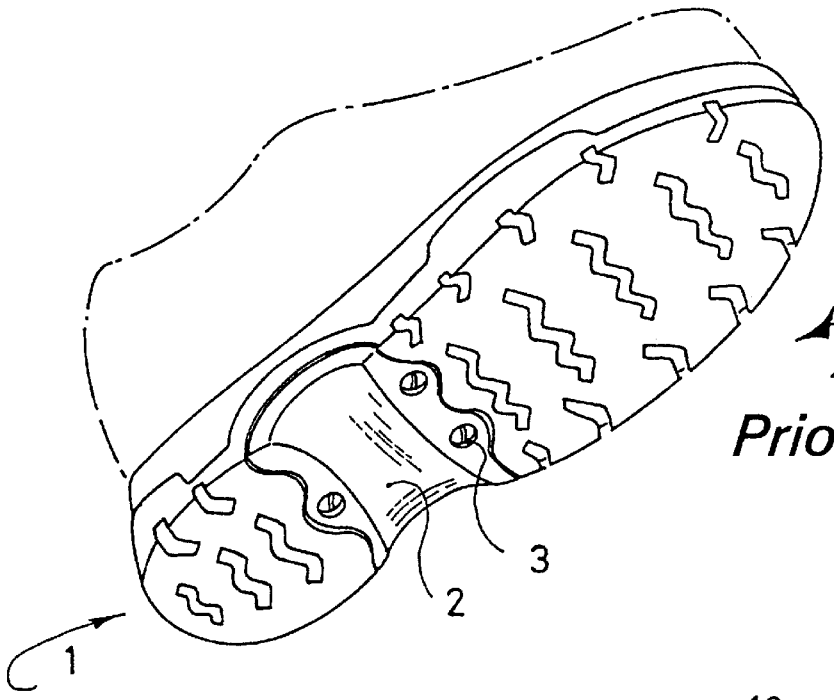
Fig: 1 Prior Art
FIG. 1 is a figure in perspective seen from below of a shoe according to the prior art.

This side rise 32 also allows for improved guidance and gripping of the sole to the glide surface, especially in the "edge setting," i.e., a sole inclined with respect to the surface because the contact surface is thus increased. As can be seen in the FIGS. 1–3, e.g., the surface portions of the side rises face, at least substantially, outwardly from the sides of the sole.

It is noted that the curvature of the rise 32 is not only inverse to the curvature of the central zone 30, but it is also oriented longitudinally in a direction perpendicular to that of the central zone 30. Preferably but not as a limitation, the radius of curvature of the rise 32 is between 40 mm and 60 mm.

It is noted that the rise 32 may also reach the upper 11 in order to protect it during glides and figures.

The longitudinal reinforcement 40 defines two aligned grooves 41, 42, arranged on either side of the transverse reinforcement 30, along the longitudinal axis 23 of the sole. Each groove 41, 42, is in fact defined by the cylindrical portion, whose concavity is turned downwards, with the same radius of curvature, preferably between 20 and 30 mm.

As shown in FIGS. 4 and 5, the bottoms of the front and rear grooves 41 and 42 are aligned and arranged less deeply than the bottom 31 of the transverse reinforcement groove 30 with respect to the lower surface of the sole. In other words, the grooves 41, 42 are not as deep as the transverse groove 30, particularly at the intersection of the grooves 41, 42 with the groove 30.

Of course, the bottoms of the grooves 41, 42 could also be aligned with the bottom 31 of the groove 30; what is essential is that the groove 30 does not form a projection with respect to these grooves 41, 42.

In this manner, the sole 20 defines on its lower surface a longitudinal groove extending over the entire length of the sole, interrupted only at the middle by the transverse groove 30. The result is the possibility of guidance over the entire length of the sole in a longitudinal direction.

In the embodiment represented in FIG. 2, each of the grooves 41, 42 is interrupted by a transverse slot 43, 44, respectively. The transverse slot 43 is wide and arranged substantially in the metatarsophalangeal articulation zone, while the thinner transverse slot 44 is placed in the heel zone.

These two slots 43, 44 allow the sole to maintain good flexibility and as a consequence good movement of the foot while walking in spite of the rigidity of the reinforcement material 30 and 40. Thus walking is made easier and safer.

In the case of FIG. 3, several slots 43, 44 are provided at the front as well as at the rear of the shoe. Of course, the number, shape, and arrangement of the slots 43, 44 varies and depends on the effect desired.

In principle, a slot is especially necessary in the zone of metatarsophalangeal articulation zone in order not to interfere with the movement of the foot.

Figure 6:
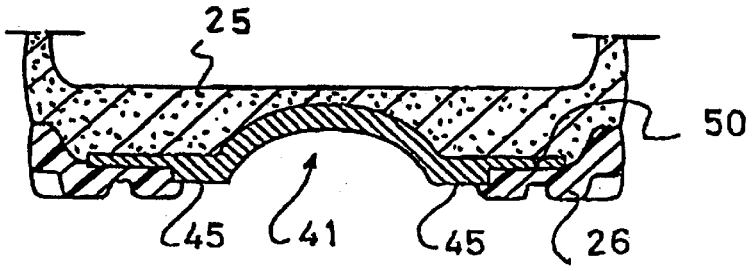
FIG. 6 is a cross-sectional view along VI—VI in FIG. 2.

The insert 30, 40 is preferably made of a single block, in one piece. According to a preferred embodiment, it is glued into the sole, between an intermediate sole 25 and a wear sole 26, and has for this purpose gripping zones 50 arranged laterally over the entire length of the insert parts 41, 42, as shown in FIG. 6. It may also be molded.

Preferably, the intermediate sole is made of a shock-absorbing material known in itself, such as a foam material (polyurethane, neoprene, or polymer foam), EVA (ethyl vinyl acetate), neoprene, etc.

Such a construction allows an absorption of shocks and is thus particularly interesting for a "grind" use implying shocks against various supports.

Depending on the shock-absorbing effect sought, the layer 25 may be more or less thick. The material may also be different if only a simple filtration effect is desired. Finally, the intermediate sole 25 may extend over the entire sole surface or only at the level of the insert 30, 40, for localized shock absorption It is likewise noted that the edge of each reinforcement piece 30, 41, 42 is provided with a ridge, respectively 35, 45, providing a wear-resistant transition between said reinforcement and the wear sole on the upper.

Figure 7:
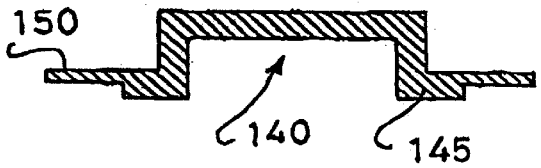
FIG. 7 is a cross-section of the insert in FIG. 6 according to another embodiment.
Figure 8:
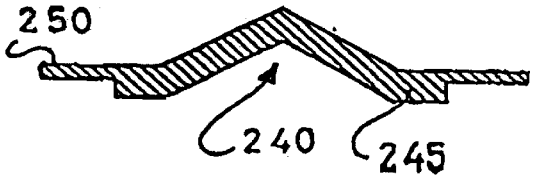
FIG. 8 is a view similar to FIG. 7 according to another embodiment.

FIGS. 7 and 8 illustrate other embodiments of the longitudinal grooves. Thus, in the case of FIG. 7, the groove 140 has a substantially rectangular cross-section, while in FIG. 8, the groove 240 has a substantially triangular cross-section. As in the preceding case, the insert is equipped with lateral gripping zones 150, 250, respectively.

Other groove cross-sections may of course be selected, according to the application sought.

FIGS. 9 to 17 illustrate a preferred embodiment of the invention in which the similar elements are designated by the same references in increments of 100.

Figure 9:
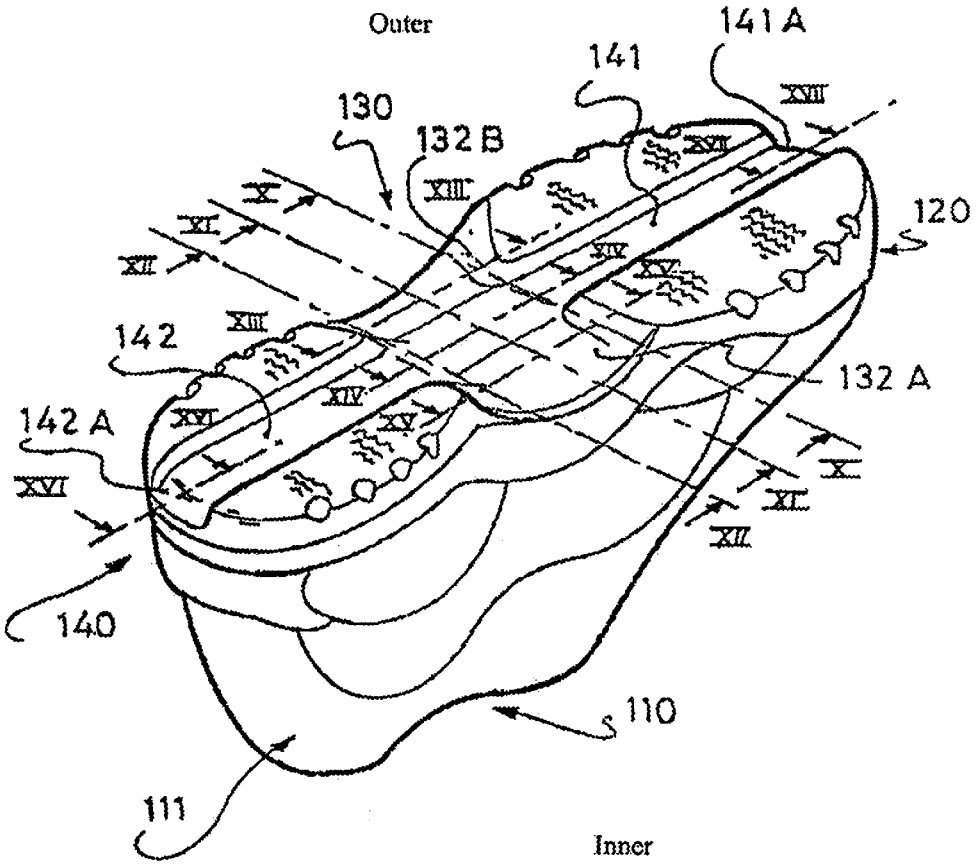
FIG. 9 is a perspective view showing the bottom of a shoe according to another preferred embodiment.

As in the shoes in FIGS. 2 and 3, the "grind" shoe 110 of FIG. 9 is made of a sole 120 overlaid by an upper 111; said sole 120 comprises on its lower surface a gliding and wear reinforcement comprising a transverse reinforcement part 130 and a longitudinal reinforcement part 140 divided into two reinforcement parts, front 141 and back 142, respectively, arranged longitudinally on either side of the transverse reinforcement part 130.

As with the preceding, the gliding and wear reinforcement 130, 140 may be one-piece, as represented in FIG. 9 or be made of two different parts.

Figure 10:
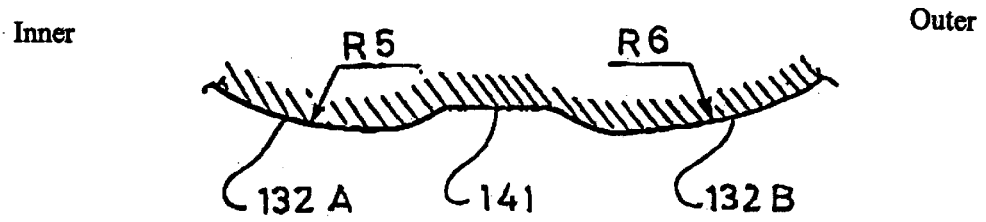
FIG. 10 is a partial cross-sectional view along X—X in FIG. 9.
Figure 12:
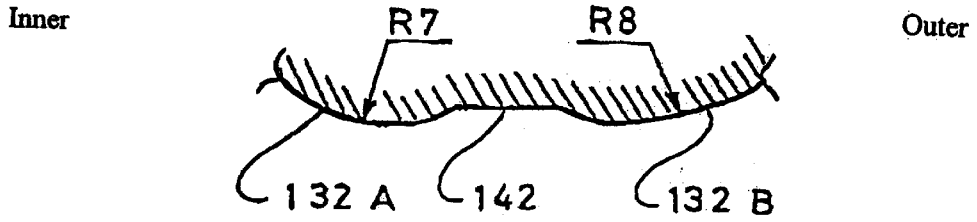
FIG. 12 is a partial cross-sectional view along XII—XII in FIG. 9.

While the longitudinal reinforcement parts 141, 142 have a substantially rectangular cross-section, as shown particularly in FIGS. 10 and 12, thus forming a sort of track with the concavity turned downwards, the transverse reinforcement part 130 has a much more complex shape, combining cylindrical surface portions that are concave in the longitudinal direction and convex in the transverse direction.

These various concavities/convexities are illustrated by the different cross-sections of FIGS. 10 to 15.

Figure 14:
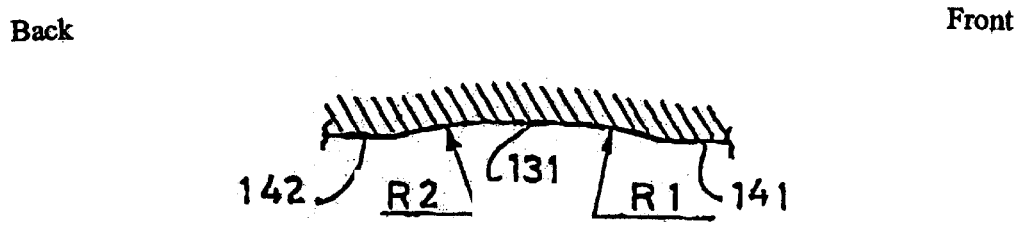
FIG. 14 is a partial cross-sectional view along XIV—XIV in FIG. 9.

In the first place, as shown by FIG. 14, the central zone 131 of the transverse reinforcement 130 has, in the longitudinal direction, a rather flat shape, even equipped with a very slight concavity oriented downwards, and connected by a deeper curvature radius R1, R2, respectively, to the longitudinal reinforcement parts 141, 142, respectively.

In this instance, the curvature radii R1, R2 have the same value, namely 45 mm.

Figure 11:
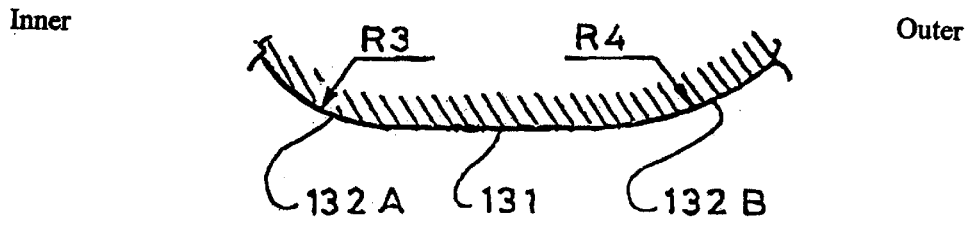
FIG. 11 is a partial cross-sectional view along XI—XI in FIG. 9.

In the transverse direction, as shown in FIG. 11, the central zone 131 also has a substantially flat shape or is equipped with a slight downwards concavity laterally extended by side rises, respectively the inner, i.e., placed on the inner or medial side of the foot—132A, and the outer, i.e., placed on the outer or lateral side of the foot—132B. These side rises 132A, 132B are in the shape of a convex curvature portions with curvature radii R3, R4, respectively.

The curvature radii R3, R4 are different on the outer and inner sides, the curvature R3 being more pronounced on the inner side. By way of example, the values are on the order of 30 mm for R3 and 55 mm for R4.

The side rises 132A, 132B have a succession of highly complex concave/convex curvature cylindrical surfaces, both in the longitudinal and transverse direction, which are illustrated more specifically in FIGS. 10 to 13 and 15.

These complex and asymmetrical forms between the inner and outer sides of the shoe are designed to offer optimal guidance and gripping of the sole on the gliding surface, especially in edge setting and to allow a jamming effect between the front and rear longitudinally opposed parts of said parts 132A, 132B.

First, at the level of their front zone, each of these side rises 132A, 132B has a convex curvature of curvature radius R5, R6, respectively, the curvature radius R5 being more accentuated on the inner side than the outer curvature radius R6.

By way of example, the curvature radius R5 can have a value on the order of 50 mm, while the curvature radius R6 has a value on the order of 100 mm.

FIG. 12 illustrates the form of the side rises 132A, 132B at the level of their rear zone, They are also in the form of cylindrical surface portions having convex curvature with the curvature radii R7, R8, respectively, differing between the inner and outer sides.

In this case, the curvature is always more accentuated on the inner side and the curvature radii R7, R8 have values on the order of 25 mm for R7 and 80 mm for R8.

To summarize, the side rises 132A, 132B have, in the transverse direction, a convex curvature, still more accentuated on the inner side of the shoe than the outer side, and whose curvature radius varies from the front towards the rear.

Figure 13:
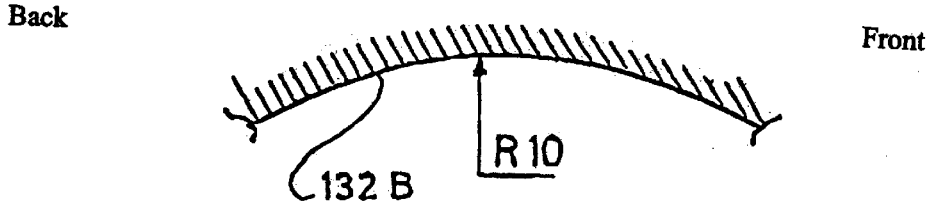
FIG. 13 is a partial cross-sectional view along XIII—XIII in FIG. 9.
Figure 15:
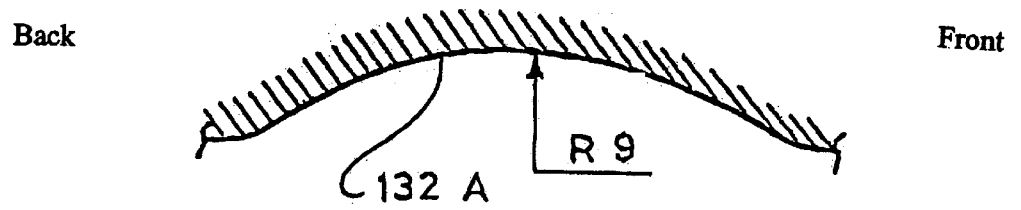
FIG. 15 is a partial cross-sectional view along XV—XV in FIG. 9.

The side rises 132A, 132B, however, have, in the longitudinal direction, a concave curvature as shown in FIGS. 13 and 15.

As before, the curvature of the inner side rise 132A is more accentuated than that of the outer side rise 132B.

By way of example, the respective curvature radii have values on the order of 65 mm for the curvature radius R9 of the inner side rise 132A, and 80 mm for the curvature radius R10 of the outer side rise 132B.

Figure 16:
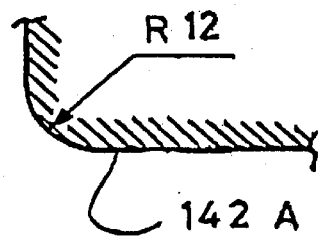
FIG. 16 is a partial cross-sectional view along XVI—XVI in FIG. 9.
Figure 17:
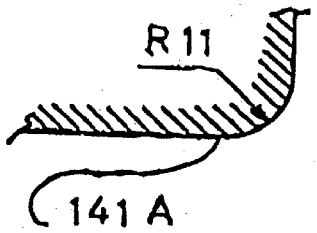
FIG. 17 is a partial cross-sectional view along XVII—XVII in FIG. 9.

Finally, FIGS. 16 and 17 show in cross-section the rear 142A and front 141A ends, respectively, of the longitudinal reinforcement parts 142, 141, respectively.

These ends 141A, 142A rise in the direction of the shoe upper by curves having curvature radii R11, R12, respectively.

In this case, the curvatures are rather accentuated and the values of curvature radii R11 and R12 are on the order of 10 mm.

Of course, the present invention is not limited to the examples of embodiment described above by way of restrictive examples but includes all similar or equivalent embodiments.

What is claimed is:

1. A shoe comprising:

a sole extending longitudinally between front and rear ends, said sole having a central zone with a lower surface;

a transverse gliding and wear reinforcement arranged in said sole central zone of said sole, said transverse reinforcement having at least one downwardly oriented curvature, said transverse reinforcement being extended on both medial and lateral sides of said sole by respective side rises, said downwardly oriented curvature of said transverse reinforcement thereby having respective extensions facing outwardly, at least substantially, from said medial and lateral sides of said sole;

a longitudinal gliding and wear reinforcement comprising a front groove longitudinally extending forwardly of said transverse reinforcement and a rear groove longitudinally extending rearwardly of said transverse reinforcement, said longitudinal gliding and wear reinforcement comprising a bottom less deep than a bottom of said transverse gliding and wear reinforcement.

2. A shoe according to claim 1, wherein:

said curvature comprises a substantially constant radius of curvature.

3. A shoe according to claim 2, wherein:

said substantially constant radius of curvature is between 30 millimeters and 50 millimeters.

4. A shoe according to claim 1, wherein:

each of said side rises has at least one convex curvature in transverse cross section.

5. A shoe according to claim 4, wherein:

said at least one convex curvature of each of said side rises has a radius of curvature of between 20 millimeters and 100 millimeters.

6. A shoe according to claim 4, wherein:

said at least one convex curvature of each of said side rises varies in a longitudinal direction.

7. A shoe according to claim 4, wherein:

said at least one convex curvature of each of said side rises widens from a bottom of said curvature of said transverse gliding and wear reinforcement towards a respective one of said sides of said sole.

8. A shoe according to claim 4, wherein:

said at least one convex curvature of said side rise of said medial side of said sole is smaller than said at least one convex curvature of said side rise of said lateral side of said sole.

9. A shoe according to claim 1, wherein:

each of said side rises has a longitudinally extending concave shape.

10. A shoe according to claim 9, wherein:

said longitudinally extending concave shape of said side rise on said medial side of said sole has a radius of curvature smaller than a radius of curvature of said longitudinally extending concave shape of said side rise on said lateral side of said sole.

11. A shoe according to claim 1, wherein:

each of said front and rear grooves has a partly cylindrical shape having a downwardly oriented concave curvature.

12. A shoe according to claim 11, wherein:

each of said concave curvatures of said front and rear grooves has a substantially constant radius of curvature.

13. A shoe according to claim 12, wherein:

said constant radius of curvature is between 20 millimeters and 30 millimeters.

14. A shoe according to claim 1, wherein:

each of front and rear grooves of said longitudinal gliding and wear reinforcement has a substantially triangular shaped transverse cross section.

15. A shoe according to claim 1, wherein:

each of front and rear grooves of said longitudinal gliding and wear reinforcement has a substantially rectangular shaped transverse cross section.

16. A shoe according to claim 1, wherein:

said longitudinal gliding and wear reinforcement is interrupted by at least one substantially transverse flexion zone.

17. A shoe according to claim 1 wherein:

each of said front and rear grooves of said longitudinal gliding and wear reinforcement is interrupted, respectively, by at least one substantially transverse flexion zone.

18. A shoe according to claim 16, wherein:

said flexion zone is arranged in a metatarsophalangeal articulation zone.

19. A shoe according to claim 16, wherein:

each said flexion zone consists of a transverse slot in said longitudinal gliding and wear reinforcement.

20. A shoe according to 18, wherein:

each said flexion zone consists of a transverse slot in said longitudinal gliding and wear reinforcement.

21. A shoe according to claim 1, wherein:

said longitudinal gliding and wear reinforcement and said transverse gliding and wear reinforcement have bottoms on a common level.

22. A shoe according to claim 1, wherein:

said longitudinal gliding and wear reinforcement and said transverse gliding and wear reinforcement are made of a unitary piece.

23. A shoe according to claim 1, wherein:

said longitudinal gliding and wear reinforcement and said transverse gliding and wear reinforcement are separate from a remainder of said sole and are molded in said sole.

24. A shoe according to claim 1, wherein:

said sole further comprises an intermediate sole and a lower sole having a lowermost sole surface, said transverse and longitudinal gliding and wear inserts being secured between said intermediate and lower soles.

25. A shoe comprising:

a sole extending longitudinally between front and rear ends, said sole having a central zone with a lower surface;

a transverse gliding and wear reinforcement arranged in said sole central zone of said sole, said transverse reinforcement having at least one downwardly oriented curvature;

a longitudinal gliding and wear reinforcement comprising a front groove longitudinally extending forwardly of said transverse reinforcement and a rear groove longitudinally extending rearwardly of said transverse reinforcement;

said longitudinal gliding and wear reinforcement comprising a bottom less deep than a bottom of said transverse gliding and wear reinforcement.

26. A shoe according to claim 25, wherein:

said front groove and said rear groove of said longitudinal gliding and wear reinforcement have respective bottoms at a common level.

27. A shoe according to claim 25, wherein:

said curvature of said transverse gliding and wear reinforcement comprises a substantially constant radius of curvature.

28. A shoe according to claim 27, wherein:

said substantially constant radius of curvature is between 30 millimeters and 50 millimeters.

29. A shoe according to claim 25, wherein:

said transverse reinforcement is extended on both medial and lateral sides of said sole by respective side rises, said downwardly oriented curvature of said transverse reinforcement thereby having respective extensions facing outwardly, at least substantially, from said medial and lateral sides of said sole, each of said side rises has at least one convex curvature in transverse cross section.

30. A shoe according to claim 29, wherein:

said at least one convex curvature of each of said side rises has a radius of curvature of between 20 millimeters and 100 millimeters.

31. A shoe according to claim 29, wherein:

said at least one convex curvature of each of said side rises varies in a longitudinal direction.

32. A shoe according to claim 29, wherein:

said at least one convex curvature of each of said side rises widens from a bottom of said curvature of said transverse gliding and wear reinforcement towards a respective one of said sides of said sole.

33. A shoe according to claim 29, wherein:

said at least one convex curvature of said side rise of said medial side of said sole is smaller than said at least one convex curvature of said side rise of said lateral side of said sole.

34. A shoe according to claim 29, wherein:

each of said side rises has a longitudinally extending concave shape.

35. A shoe according to claim 34, wherein:

said longitudinally extending concave shape of said side rise on said medial side of said sole has a radius of curvature smaller than a radius of curvature of said longitudinally extending concave shape of said side rise on said lateral side of said sole.

36. A shoe according to claim 25, wherein:

each of said front and rear grooves has a partly cylindrical shape having a downwardly oriented concave curvature.

37. A shoe according to claim 36, wherein:

each of said concave curvatures of said front and rear grooves has a substantially constant radius of curvature.

38. A shoe according to claim 37, wherein:

said constant radius of curvature is between 20 millimeters and 30 millimeters.

39. A shoe according to claim 25, wherein:

each of front and rear grooves of said longitudinal gliding and wear reinforcement has a substantially triangular shaped transverse cross section.

40. A shoe according to claim 25, wherein:

each of front and rear grooves of said longitudinal gliding and wear reinforcement has a substantially rectangular shaped transverse cross section.

41. A shoe according to claim 25, wherein:

said longitudinal gliding and wear reinforcement is interrupted by at least one substantially transverse flexion zone.

42. A shoe according to claim 25, wherein:

each of said front and rear grooves of said longitudinal gliding and wear reinforcement is interrupted, respectively, by at least one substantially transverse flexion zone.

43. A shoe according to claim 41, wherein:

said flexion zone is arranged in a metatarsophalangeal articulation zone.

44. A shoe according to claim 41, wherein:

each said flexion zone consists of a transverse slot in said longitudinal gliding and wear reinforcement.

45. A shoe according to 43, wherein:

each said flexion zone consists of a transverse slot in said longitudinal gliding and wear reinforcement.

46. A shoe according to claim 25, wherein:

said longitudinal gliding and wear reinforcement comprises a bottom less deep than a bottom of said transverse gliding and wear reinforcement.

47. A shoe according to claim 25, wherein:

said longitudinal gliding and wear reinforcement and said transverse gilding and wear reinforcement have bottoms on a common level.

48. A shoe according to claim 25, wherein:

both said front groove and said rear groove of said longitudinal gliding and wear reinforcement comprise respective uppermost surfaces higher a surface of said transverse gliding and wear reinforcement at an intersection of said longitudinal and transverse gliding and wear reinforcements.

49. A shoe according to claim 25, wherein:

said longitudinal gliding and wear reinforcement and said transverse gliding and wear reinforcement are made of a unitary piece.

50. A shoe according to claim 25, wherein:

said longitudinal gliding and wear reinforcement and said transverse gilding and wear reinforcement are separate from a remainder of said sole and are molded in said sole.

51. A shoe according to claim 25, wherein:

said sole further comprises an intermediate sole and a lower sole having a lowermost sole surface, said transverse and longitudinal gliding and wear inserts being secured between said intermediate and lower soles.

52. A grind shoe comprising:

a sole extending longitudinally between front and rear ends, said sole having a central zone with a lower surface;

a gliding and wear reinforcement, said reinforcement comprising a transverse portion and a longitudinal portion;

said transverse portion being arranged in said sole central zone of said sole and having at least one downwardly oriented concave curvature in longitudinal cross section, said transverse portion of said gliding and wear reinforcement extending transversely between medial and lateral sides of said sole;

said transverse portion being extended on both medial and lateral sides of said sole by respective side rises, said downwardly oriented concave curvature of said transverse reinforcement thereby having respective extension surface portions facing, at least substantially, outwardly from said medial and lateral sides of said sole, transitions between said side rises and a remainder of said transverse portion of said gliding and wear reinforcement being continuous, each of said side rises having at least one convex curvature in transverse cross section, said at least one convex curvature of each of said side rises having a radius of curvature of between 20 millimeters and 100 millimeters.

53. A grind shoe according to claim 52, wherein:

said at least one convex curvature of each of said side rises varies in a longitudinal direction.

54. A grind shoe according to claim 52, wherein:

said at least one convex curvature of each of said side rises widens from a bottom of said curvature of said transverse portion of said gliding and wear reinforcement towards a respective one of said sides of said sole.

* * * * *